US005533757A

United States Patent [19]

Morris

[11] Patent Number: 5,533,757

[45] Date of Patent: Jul. 9, 1996

[54] CHILDREN'S BOOK HAVING NOISE MAKING CAPABILITY

[75] Inventor: Michael Morris, Weston, Conn.

[73] Assignee: Joshua Morris Publishing, Inc., Westport, Conn.

[21] Appl. No.: 430,987

[22] Filed: Apr. 28, 1995

[51] Int. Cl.[6] ..... A63H 5/00; A63H 33/38; B42D 1/00

[52] U.S. Cl. ..... 281/15.1; 281/51; 283/63.1; 446/196; 446/216; 446/404

[58] Field of Search ..... 283/63.1; 281/51, 281/15.1; 446/188, 195, 196, 204–208, 213, 216, 397, 404

[56] References Cited

U.S. PATENT DOCUMENTS

| | | | |
|---|---|---|---|
| 2,546,680 | 3/1951 | Samuels . | |
| 3,092,927 | 6/1963 | Luchsinger . | |
| 4,249,757 | 2/1981 | Gella | 281/15.1 |
| 4,443,201 | 4/1984 | Diefenbach . | |
| 4,490,123 | 12/1984 | Becker et al. | 281/51 X |
| 4,778,391 | 10/1988 | Weiner . | |
| 5,118,138 | 6/1992 | Brotz . | |
| 5,290,190 | 3/1994 | McClanahan . | |
| 5,374,195 | 12/1994 | McClanahan . | |

*Primary Examiner*—Frances Han
*Attorney, Agent, or Firm*—Kenyon & Kenyon

[57] ABSTRACT

A book having a sound producing capability which attracts the attention and interest of children and which does not require batteries or another source of electrical power. The book has a hollow spine or binding defining a conduit which slidably contains a noise making device, such as a whistle, therein. In the preferred embodiment, the spine of the book is a hollow tubular member which slidably receives a member which produces sound as it slides through the tubular member, under the force of gravity, due to the forced passage of air through tortuous paths and/or constricted openings or slits in the member (e.g., as in a whistle or the like).

13 Claims, 2 Drawing Sheets

CHILDREN'S BOOK HAVING NOISE MAKING CAPABILITY

BACKGROUND OF THE INVENTION

1. Field of the Invention

The invention relates generally to a book which engenders the attention and interest of a child.

2. Description of Related Art

A wide assortment of toys and games having sound producing capability are known. In addition, children's books have been provided with an audio tape of the text so as to allow the child to listen to the text as the child learns to read.

Children's books having an integral sound producing capability have also been known. For example, U.S. Pat. No. 5,374,195 describes a talking book in which the switches that operate the books audio system are carried by inserts placed in lateral channels in the pages of the book. U.S. Pat. No. 5,290,190 describes a talking book wherein all of the audio components are located on the pages or in the binding.

These known sound producing books require electrical components (e.g., battery operated components controlled by switches) to generate the sound. However, I have appreciated that it would be desirable to provide a children's book having a mechanical noise making feature integrally incorporated into the book, for the sake of simplicity, ease of manufacture, ease of use and unlimited shelf life.

SUMMARY OF THE INVENTION

It is an object of the invention to provide a book having a sound producing capability which attracts the attention and interest of children.

It is a further object of the invention to provide a children's type book having a sound producing capability, which does not require batteries or another source of electrical power, and therefore has an unlimited life.

It is yet a further object of the invention to provide such a book wherein the sound producing element is a mechanical element which is integrally incorporated into the book itself, which is activated by movement of the book and which does not require a switch to be activated.

These and other objects of the invention are achieved by a book having a hollow spine or binding defining a conduit which slidably contains a noise making device, such as a whistle, therein. In the preferred embodiment, the spine of the book is a hollow tubular member which slidably receives a member which produces sound, as it slides through the tubular member under the force of gravity, due to the forced passage of air through tortuous paths and/or constricted openings or slits in the member (e.g., as in a whistle or the like). Alternatively, the sound producing member may be fixed in the hollow tubular member so as to remain stationary, and a solid slidable member may be provided to force air through the stationary sound producing member.

DETAILED DESCRIPTION OF THE INVENTION

Figure 1:
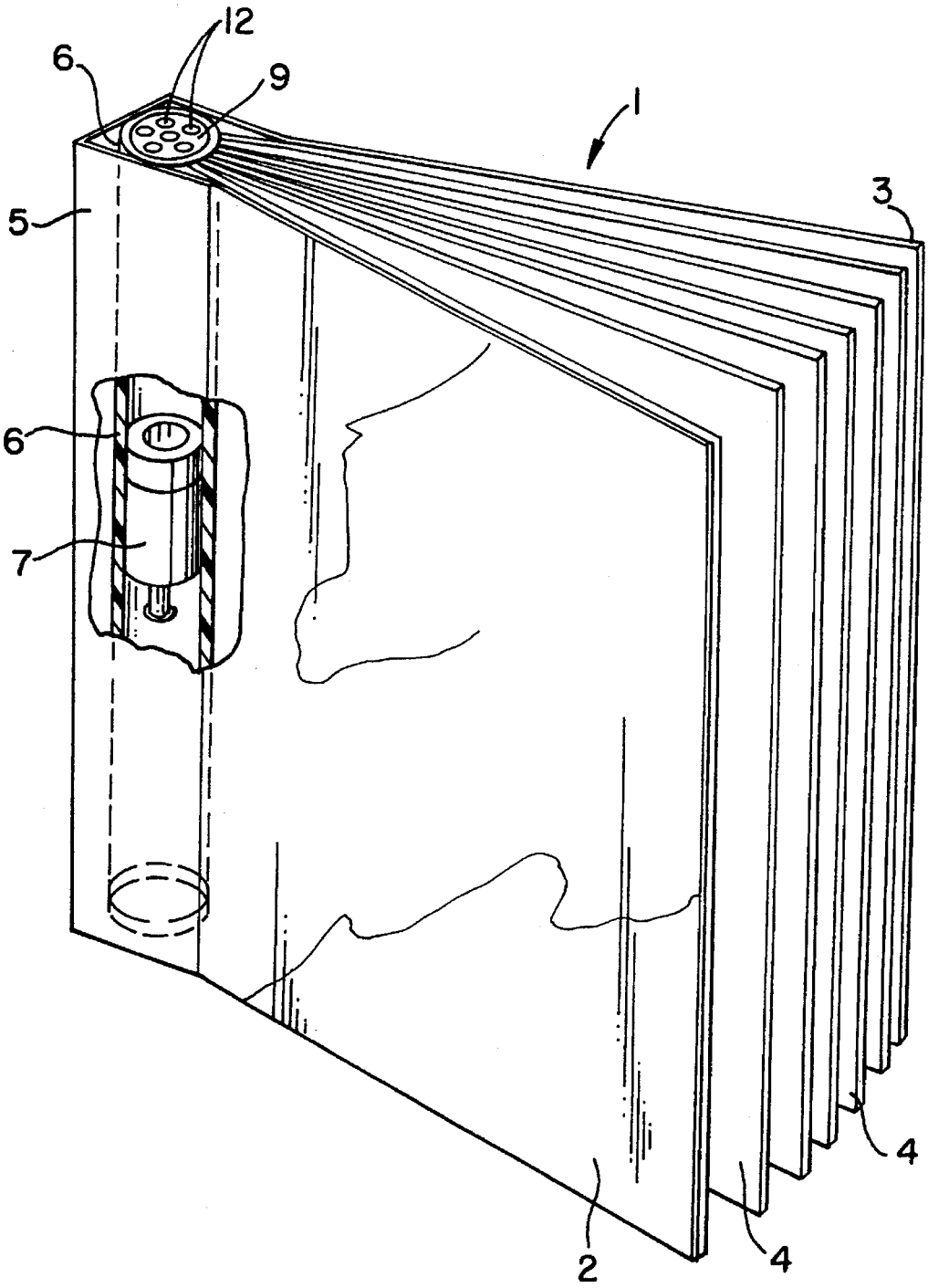
FIG. 1 is a perspective view of a sound producing book in accordance with the invention, wherein a section of the spine of the book is cut away to reveal the noise making element in the hollow tubular member of the spine.

Referring to FIG. 1, a book in accordance with the invention is generally illustrated at 1. However, it should be appreciated that the invention need not be a book per se, but can also be a magazine, pamphlet, coloring book, etc. Thus, as used herein, the term book refers to a book, magazine, pamphlet or any other structure containing printed pages. The book includes a front cover 2, a back cover 3 and a multiplicity of pages 4 therebetween, as in a conventional book. Preferably, the front cover 2 and back cover 3 are "hard covers" for reasons which will become apparent.

The book 1 includes a binding or spine 5 to which the front and back covers 2, 3 are bound. The binding 5 includes a channel or hollow tubular member 6 which extends therethrough from top to bottom. Pages 4 are bound to the outer surface of tubular member 6. However, it should be noted that binding 5 and hollow tubular member 6 need not be separate elements. Rather, the binding 5 and the tubular member 6 can be one in the same element to which the covers 2, 3 and pages 4 are attached, provided that it is still hollow.

Figure 2:
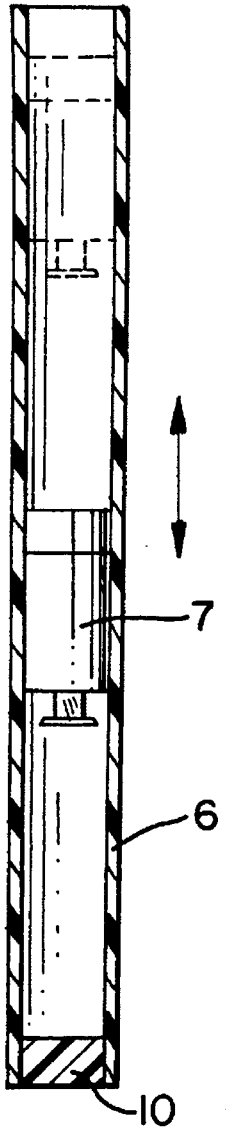
FIG. 2 is an isolated side view of the spine of the book which reveals the noise making element in phantom in a top position and the noise making element in a middle position to illustrate the sliding movement of the element.

Hollow tubular member 6 slidably receives a conventional noise making device, such as a whistle 7. The noise making device 7 must be free to slide down the tubular spine 6 under the force of gravity. This is illustrated in FIG. 2 where the noise making device 7 is illustrated in phantom at the top of the tubular member 6, and then illustrated again, sliding down the tubular member. However, where the noise making device 7 is a whistle, it is also important that the outer surface of the device 7 be substantially flush with the inner surface of tubular member 6, as illustrated, so that no substantial amount of air can pass between the periphery of whistle 7 and the inner surface of tubular member 6. This is important because it is necessary for the air to be forced through the whistle 7, as it slides down the tubular member 6, in order to generate the whistle sound. In order to facilitate free sliding movement of whistle 7 through tubular member 6, both the outer surface of whistle 7 and the inner surface of tubular member 6 should be smooth.

Binding 5 is required to be sufficiently rigid to define a channel through which noise making element 7 can slide where a separate hollow tubular member 6 is not provided. The covers 2 and 3 of the book 1 are preferably hard covers, so that they do not easily tear away from the binding 5. Preferably, the book is a so-called "board book" for children which has very thick, hard covers and pages.

Both the top and the bottom of tubular member 6 are closed or capped to prevent the noise making element 7 from falling out of the member as the book is moved. Preferably, one end of the tubular member 6 is formed (e.g., molded) closed 10 and the opposite end is closed with a cap 9 after the sound producing element 7 has been inserted in the tubular member 6 during manufacture for ease of assembly. The cap 9 may then be permanently secured to the tubular member 6 (e.g., by glue) if desired, or the cap may be left removable for removal by the user. If the cap 9 is removable, the sound producing element may be removed and substituted by the user. In such an embodiment, an assortment of different sound producing members may be provided with the book. Preferably, the cap 9 defines a multiplicity of small apertures 12 therein, as illustrated in FIG. 1, for the purpose of permitting air and sound to escape therefrom in a uniform manner. Cap 9 may also have a single aperture provided that it is small enough to prevent sound producing element 7 from falling out of the binding.

As known in the art, there are a large number of different noise making elements which operate on the principle of air being forced through a tortuous path and/or a constricted opening or slit. Any of these conventional noise making devices may be used in the present invention, provided that they are adapted to be slidable through the hollow spine 5 of the book. A variety of different sounds can be produced from these conventional noise making elements. For example, low pitch sound producing elements may be used to simulate the sound of a cow. High pitch, whistle type elements, may also be used.

Figure 3:
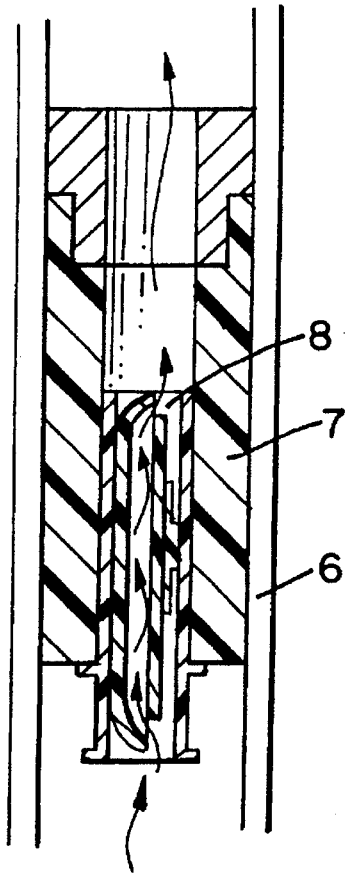
FIG. 3 is an isolated cross-sectional side view of an example of a noise making element which can be used in the invention, illustrating the tortuous path of air through the element as it slides down the spine of the book.

FIG. 3 is a cross-sectional view of a conventional high pitch whistle type sound producing element, as it slides down tubular member 6 of book 1. The whistle includes a constricted opening 8 through which the flow of air is forced as the whistle slides down the binding under the force of gravity. Of course, the air must pass through the whistle under sufficient speed and force to cause sound to be emitted. For this purpose, the sound producing element 7 must be sufficiently heavy because the force which forces the air through the whistle is gravity. In the case of a high pitch whistle type sound producing element, the whistle can weigh, e.g., at least about 0.25 lbs. However, in the case of low pitch sound producing elements, even a lighter weight may suffice, since it is well known that low pitch elements require less air pressure to emit sound.

The noise making element 7 may be of the two-way variety whereby sound will be emitted no matter which direction the device 7 slides in (i.e., no matter which direction air is forced through it). Alternatively, the noise making device 7 may be one-way so as to generate noise when moved in only one direction.

Thus, it will be appreciated that each time the book 1 is turned over from top to bottom, the slidable noise making element 7 will emit sound as air is forced through it. The sound emitting feature of the book of the invention will attract the attention and interest of children. The invention has the additional advantage that it can be manufactured in a simple and inexpensive manner.

In another embodiment of the invention, the noise making element 7 may be fixed in the tubular member 6 so as to be stationary. In this embodiment, a separate slidable member (not illustrated) is provided in the tubular member 6. This separate slidable member should be air-impermeable (e.g., a solid piece of metal or heavy plastic) so that no air can pass through it as it slides through the tubular member 6 under the force of gravity. The outer side surface of the slidable member should be substantially flush with the inner surface of the tubular member 6 to prevent air from passing around it. This will result in the member forcing air through the tubular member 6 and through the noise making element 7 (which is fixed in place in the tubular member 6) as the impermeable member slides under the force of gravity. Preferably, the noise making element 7 is fixed at or near an end of the tubular member 6 to maximize the length of the tubular member 6 in which the solid member is free to slide.

In the preceding specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A sound producing book comprising: a multiplicity of pages; a front cover; a back cover, said pages and covers being bound along one side thereof to a binding member, said binding member including a conduit therethrough; and a sound producing member slidably contained in said conduit and capable of sliding within the conduit under the force of gravity to produce sound.

2. The book according to claim 1 wherein the conduit is closed at a first end, and capped at a second end by a cap which defines at least one aperture therethrough.

3. The book according to claim 2 wherein the sound producing member is a whistle.

4. The book according to claim 2 wherein the conduit is defined by a tubular member.

5. The book according to claim 2 wherein the cap is removable.

6. The book according to claim 2 wherein the sound producing member produces sound as air is forced through it upon sliding within the conduit under the force of gravity.

7. The book according to claim 1 wherein the sound producing member is a whistle.

8. The book according to claim 7 wherein the conduit is defined by a tubular member.

9. The book according to claim 7 wherein the sound producing member produces sound as air is forced through it upon sliding within the conduit under the force of gravity.

10. The book according to claim 1 wherein the conduit is defined by a tubular member.

11. The book according to claim 10 wherein the sound producing member produces sound as air is forced through it upon sliding within the conduit under the force of gravity.

12. The book according to claim 1 wherein the sound producing member produces sound as air is forced through it upon sliding within the conduit under the force of gravity.

13. A sound producing book comprising: a multiplicity of pages; a front cover; a back cover, said pages and covers being bound along one side thereof to a binding member, said binding member including a conduit therethrough; a sound producing member fixed in the conduit, said sound producing member being capable of producing sound as air is forced through it; and an air-forcing member slidably contained in said conduit which is capable of sliding within the conduit under the force of gravity to force air through the sound producing member to produce sound.

* * * * *